US010079446B1

(12) United States Patent
Sundarakrishnamachari et al.

(10) Patent No.: US 10,079,446 B1
(45) Date of Patent: Sep. 18, 2018

(54) ELECTRICAL CONNECTOR WITH CAM ACTUATED TERMINAL LOCK

(71) Applicant: Delphi Technologies, Inc., Troy, MI (US)

(72) Inventors: Rangarajan Sundarakrishnamachari, Chennai (IN); Sivakumar Niranjan, Tamil Nadu (IN); Velmurugan Kandasamy, Tamil Nadu (IN); John Schneider, Warren, OH (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 15/817,366

(22) Filed: Nov. 20, 2017

(51) Int. Cl.
*H01R 13/62* (2006.01)
*H01R 13/436* (2006.01)

(52) U.S. Cl.
CPC ..... *H01R 13/4364* (2013.01)

(58) Field of Classification Search
CPC ..... H01R 13/62938; H01R 13/62933
USPC ..... 439/157, 372
See application file for complete search history.

(56) References Cited

U.S. PATENT DOCUMENTS 5,695,349 A * 12/1997 Taguchi ..... H01R 13/62938 439/157
7,396,242 B2 * 7/2008 Dekoski ..... H01R 13/62955 439/157
8,105,099 B2 * 1/2012 Suzuki ..... H01R 13/193 439/157
8,147,261 B2 * 4/2012 Horiuchi ..... H01R 13/514 439/157
8,794,993 B2 * 8/2014 Norton ..... F16L 37/56 439/372
8,979,567 B2 * 3/2015 Kamiya ..... H01R 13/62977 439/157
8,998,626 B2 * 4/2015 Kitajima ..... H01R 12/716 439/147

* cited by examiner

*Primary Examiner* — Thanh Tam Le
(74) *Attorney, Agent, or Firm* — Robert J. Myers

(57) ABSTRACT

An electrical connector includes a first-housing, a second-housing, a slideable-skirt, and a terminal-lock. The second-housing is configured to mate with the first-housing along a longitudinal-mating-axis. The second-housing defines a slot in a top-side of the second-housing extending along a lateral-axis orthogonal to the longitudinal-mating-axis. The slideable-skirt is mounted to the second-housing and is moveable from a pre-stage position to a seated-position along the longitudinal-mating-axis. The slideable-skirt overlays a portion of a perimeter of the second-housing and defines cam-slots on a first-side and a second-side of the slideable-skirt. The terminal-lock is disposed within the slot and is moveable from a terminal insertion position to a locking position. The terminal-lock includes cam-posts extending from a first-end and a second-end of the terminal-lock disposed within the cam-slots. The terminal-lock moves from the terminal insertion position to the locking position as the slideable-skirt is moved from the pre-stage position to the seated-position.

4 Claims, 7 Drawing Sheets

ELECTRICAL CONNECTOR WITH CAM ACTUATED TERMINAL LOCK

TECHNICAL FIELD OF INVENTION

This disclosure generally relates to an electrical connector, and more particularly relates to a an electrical connector that includes a terminal position assurance device.

BACKGROUND OF INVENTION

Generally an electrical connector includes a housing in which at least one electrical terminal is retained within a terminal cavity. It is known to use a terminal position assurance (TPA) device to inhibit an axial movement of electrical terminals housed within the terminal cavity of the housing. A packaging challenge arises when electrical terminals of various sizes are housed within a same electrical connector and require different TPA device designs which may operate in two different directions.

The subject matter discussed in the background section should not be assumed to be prior art merely as a result of its mention in the background section. Similarly, a problem mentioned in the background section or associated with the subject matter of the background section should not be assumed to have been previously recognized in the prior art. The subject matter in the background section merely represents different approaches, which in and of themselves may also be inventions.

SUMMARY OF THE INVENTION

Described herein is an electrical connector with varying electrical terminal sizes for which the geometry of the terminal cavities also varies. The varying electrical terminal sizes require unique designs of terminal position assurance (TPA) devices, for which the operating direction (axial and vertical) also varies according to a cavity design. The electrical connector integrates these TPA devices in a same housing without adversely affecting a package size. A cam driven mechanism actuates a vertical TPA that is operated by an axial TPA in a single motion.

In accordance with one embodiment, an electrical connector is provided. The electrical connector includes a first-housing, a second-housing, a slideable-skirt, and a terminal-lock. The first-housing includes a plurality of electrical-terminals. The second-housing is configured to mate with the first-housing along a longitudinal-mating-axis. The second-housing includes a plurality of corresponding electrical-terminals configured to mate with the plurality of electrical-terminals of the first-housing. The second-housing defines a slot in a top-side of the second-housing extending along a lateral-axis orthogonal to the longitudinal-mating-axis. The slideable-skirt is mounted to the second-housing and is moveable from a pre-stage position to a seated-position along the longitudinal-mating-axis. The slideable-skirt overlays a portion of a perimeter of the second-housing and defines cam-slots on a first-side and a second-side of the slideable-skirt. The terminal-lock is disposed within the slot and moveable from a terminal insertion position to a locking position along a transverse-axis orthogonal to the lateral-axis and the longitudinal-mating-axis. The terminal-lock is configured to inhibit a longitudinal-movement of the plurality of corresponding electrical-terminals. The terminal-lock includes cam-posts extending from a first-end and a second-end of the terminal-lock disposed within the cam-slots of the slideable-skirt. The terminal-lock moves from the terminal insertion position to the locking position as the slideable-skirt is moved from the pre-stage position to the seated-position.

The second-housing further defines a plurality of terminal-cavities, and the terminal-lock simultaneously engages the plurality of electrical-terminals disposed within the plurality of terminal-cavities as the terminal-lock moves from the terminal insertion position to the locking position.

The slideable-skirt includes an actuation-rib projecting from an inner-surface of the slideable-skirt, and the terminal-lock includes a flexible-lock that retains the terminal-lock at the top-side of the second-housing. The actuation-rib disengages the flexible-lock and enables the terminal-lock to move in the direction normal to the longitudinal-mating-axis when the slideable-skirt is moved from the pre-stage position to the seated-position.

The second-housing further defines a groove in the top-side of the second-housing that extends to the slot along the longitudinal-mating-axis. The actuation-rib and the flexible-lock are both disposed within the groove.

Further features and advantages will appear more clearly on a reading of the following detailed description of the preferred embodiment, which is given by way of non-limiting example only and with reference to the accompanying drawings.

BRIEF DESCRIPTION OF DRAWINGS

The present invention will now be described, by way of example with reference to the accompanying drawings, in which.

DETAILED DESCRIPTION

Figure 1:
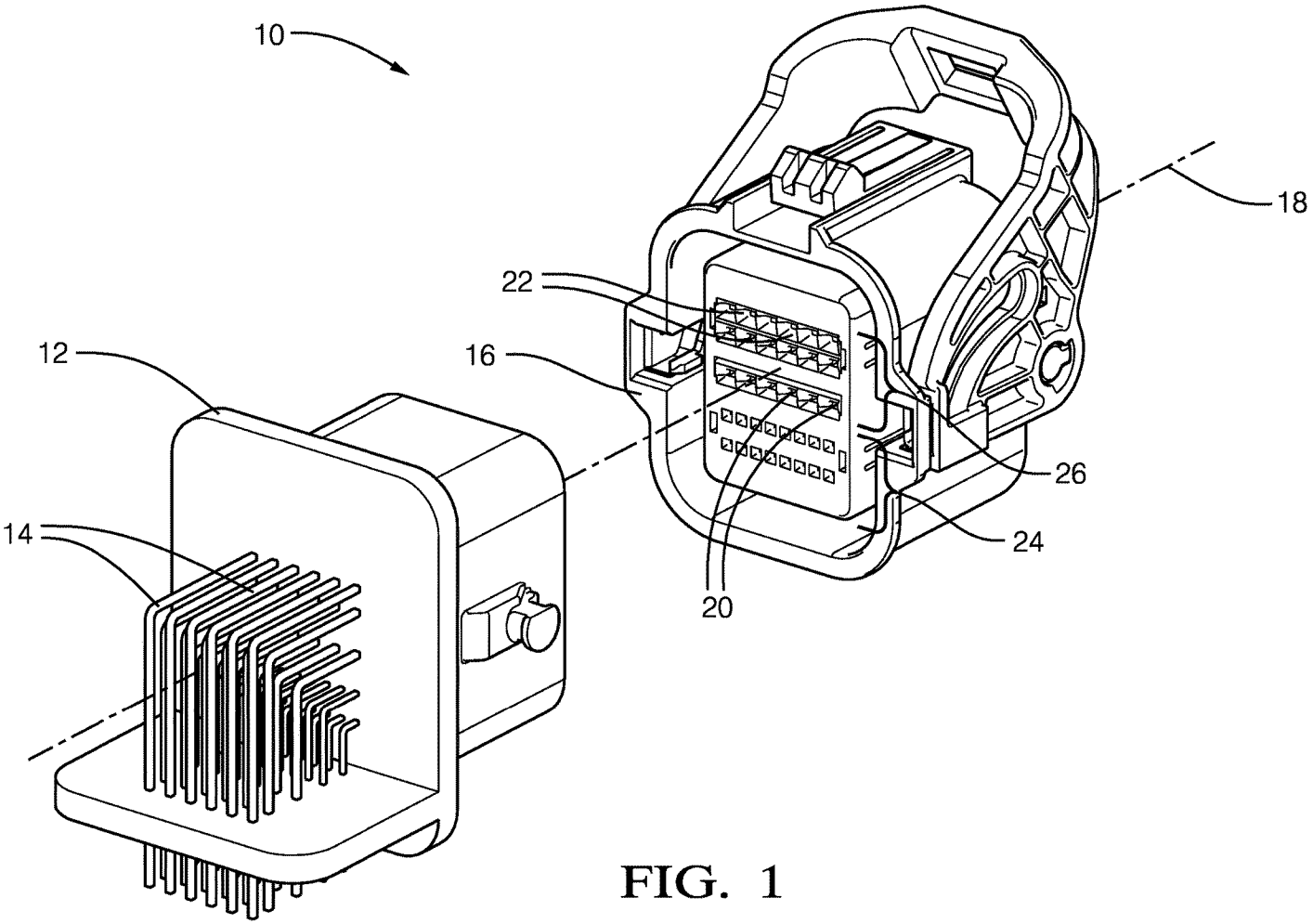
FIG. 1 is an illustration of an electrical connector in accordance with one embodiment.

FIG. 1 illustrates a non-limiting example of an electrical connector 10 in an unmated position to illustrate the internal components. The electrical connector 10 includes a first-housing 12 that includes a plurality of electrical-terminals 14. The plurality of electrical-terminals 14 may be connected to a plurality of electrical-cables (not shown), or may be connected to a printed circuit board (not shown), that may be connected to an electrical-system of a vehicle.

The electrical connector 10 also includes a second-housing 16 configured to mate with the first-housing 12 along a longitudinal-mating-axis 18. The second-housing 16 includes a plurality of corresponding electrical-terminals 20 that are configured to mate with the plurality of electrical-terminals 14 of the first-housing 12. The plurality of corresponding electrical-terminals 20 are housed within a plurality of terminal-cavities 22 defined by the second-housing 16. The terminal-cavities 22 illustrated in FIG. 1 are of two unique designs and are located in a first plurality of terminal-cavities 24 and a second plurality of terminal-cavities 26 of the second-housing 16, as will be described in more detail below.

Figure 2:
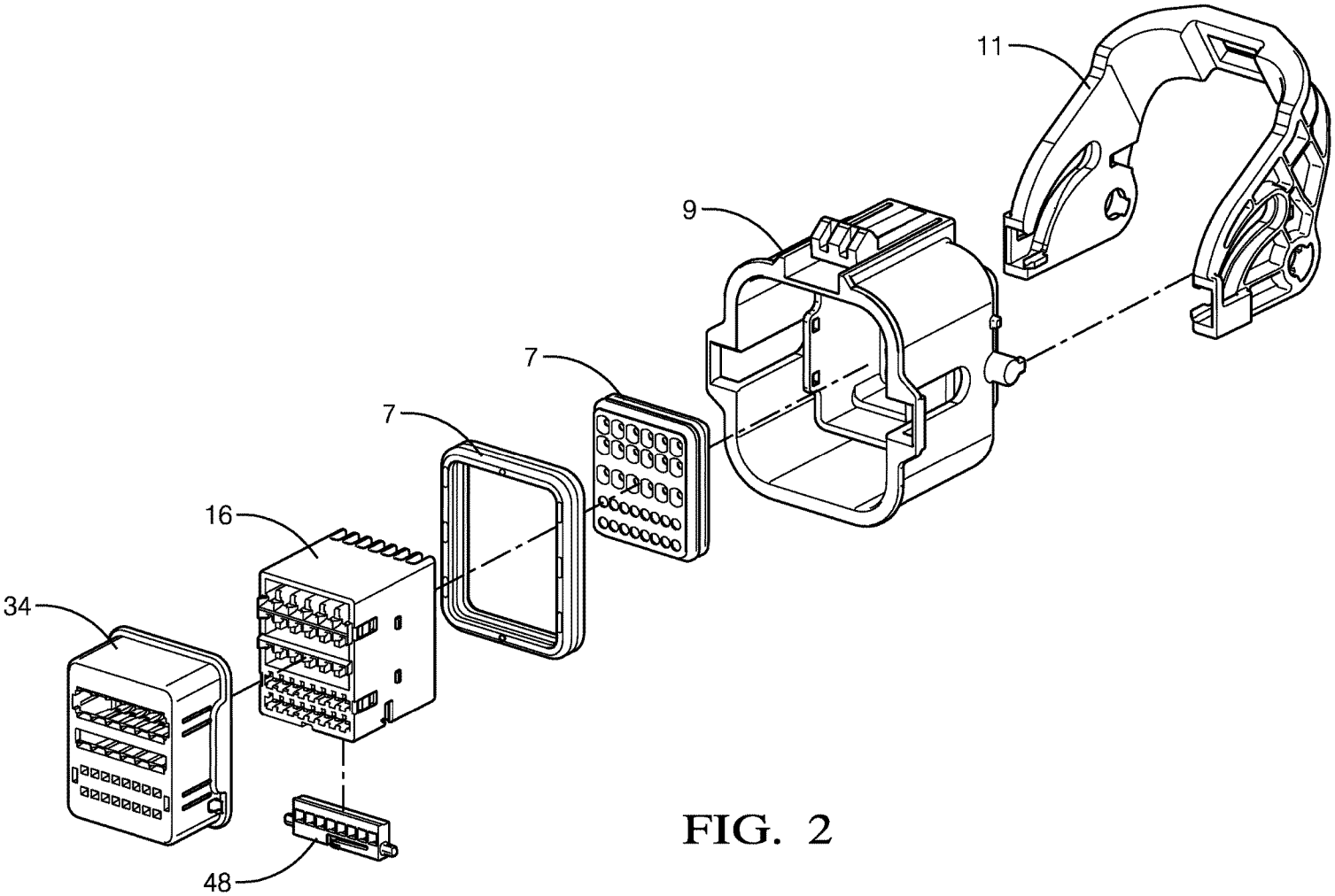
FIG. 2 is an exploded view of a second-housing of the electrical connector of FIG. 1 in accordance with one embodiment.

FIG. 2 is an exploded view of the second-housing 16 and illustrates an arrangement of other components including seals 7, a shroud 9, a lever 11 for latching the second-housing 16 to the first-housing 12.

Figure 3:
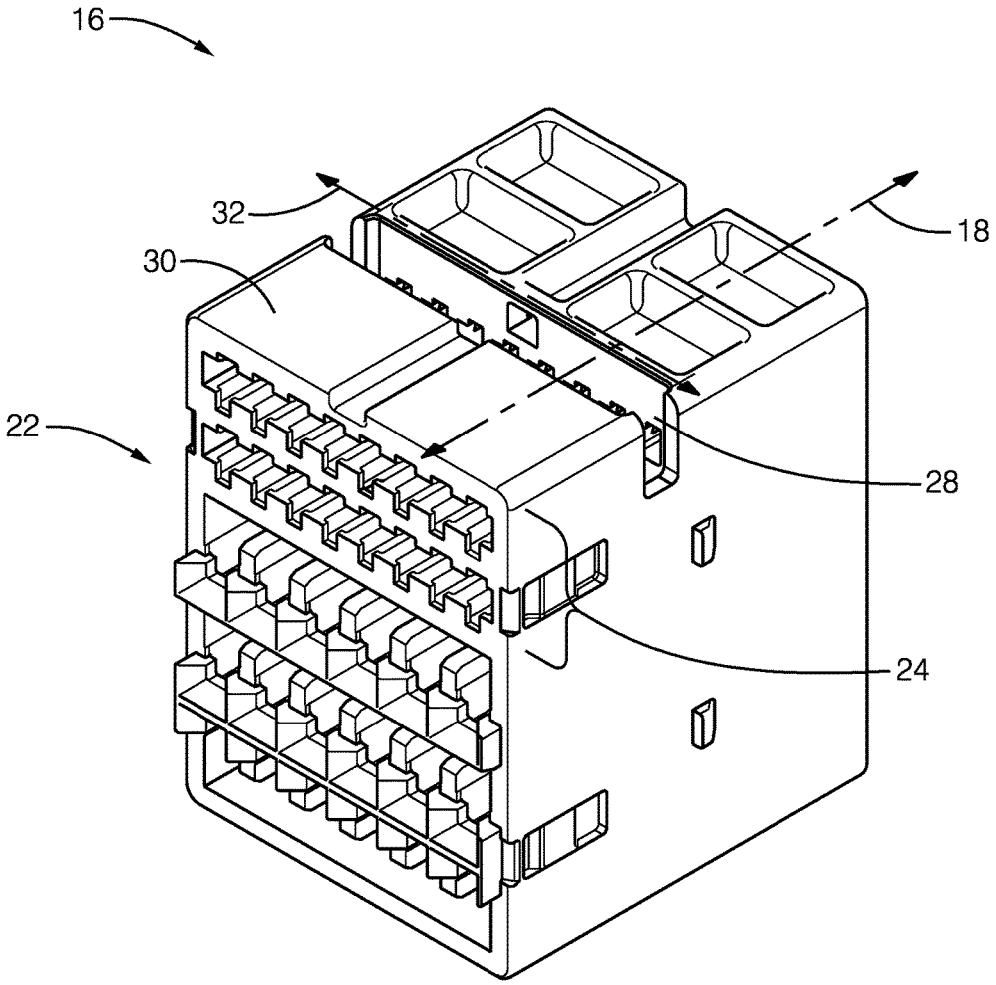
FIG. 3 is an illustration of the second-housing of FIG. 2 isolated from other components in accordance with one embodiment.

FIG. 3 illustrates the second-housing 16 isolated from the other components of FIG. 2, and is rotated 180 degrees to more clearly show design features described herein. The second-housing 16 defines a slot 28 in a top-side 30 of the second-housing 16 extending along a lateral-axis 32 orthogonal to the longitudinal-mating-axis 18. The slot 28 is in communication with the first plurality of terminal-cavities 24 (i.e. the top two rows of terminal-cavities 22).

Figure 4A:
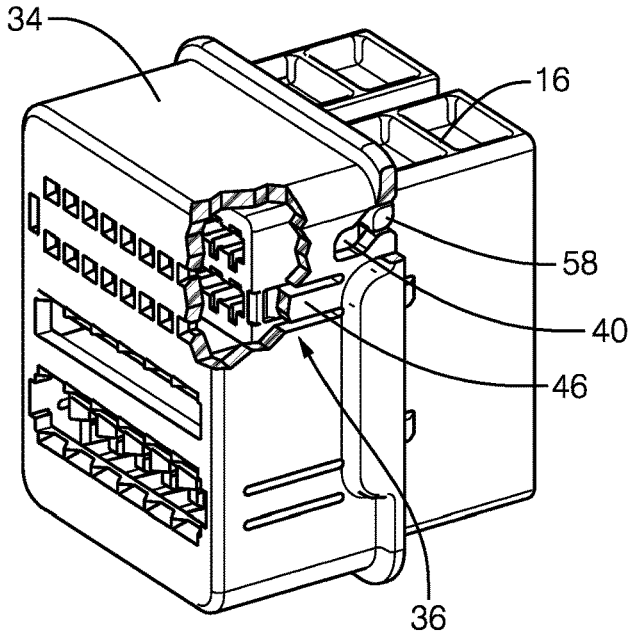
FIG. 4A is a section-view of the second-housing of FIG. 2 with a slideable-skirt in a pre-stage position in accordance with one embodiment.
Figure 4B:
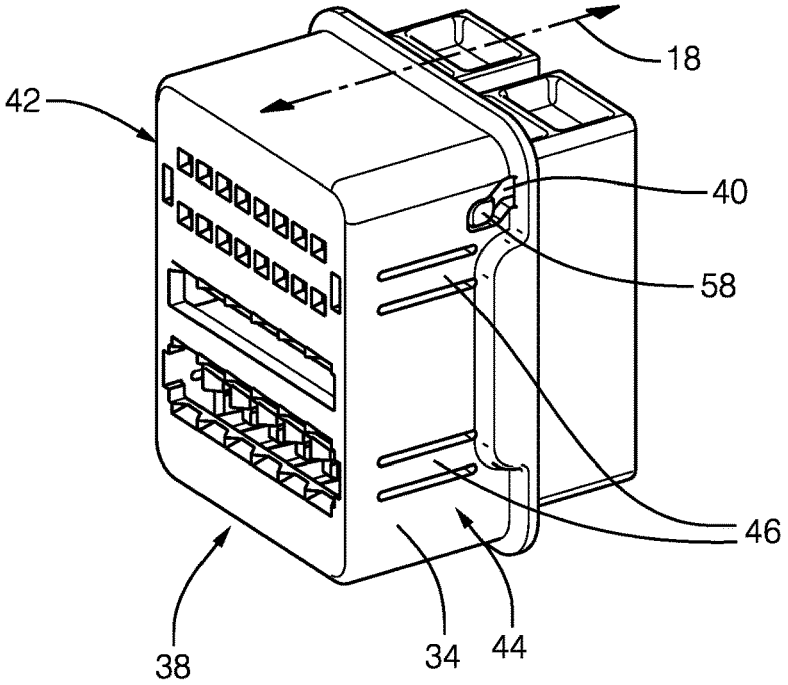
FIG. 4B is an illustration of the second-housing of FIG. 4A with the slideable-skirt in a seated-position in accordance with one embodiment.

FIGS. 4A-4B illustrate the second-housing 16 with both axial and vertical terminal position assurance (TPA) devices in place. The connector 10 also includes a slideable-skirt 34 (i.e. the axial TPA device) mounted to the second-housing 16 and moveable along the longitudinal-mating-axis 18 from a pre-stage position 36 (see FIG. 4A) to a seated-position 38 (see FIG. 4B). The slideable-skirt 34 overlays a portion of a perimeter of the second-housing 16 and defines cam-slots 40 on a first-side 42 and a second-side 44 of the slideable-skirt 34. The slideable-skirt 34 is retained in the pre-stage position 36 by skirt-locks 46 located on the first-side 42 and the second-side 44 of the slideable-skirt 34 as illustrated in the section-view of FIG. 4A until a force exerted on the slideable-skirt 34 by an assembler exceeds a retention force threshold provided by the skirt-locks 46.

Figure 5A:
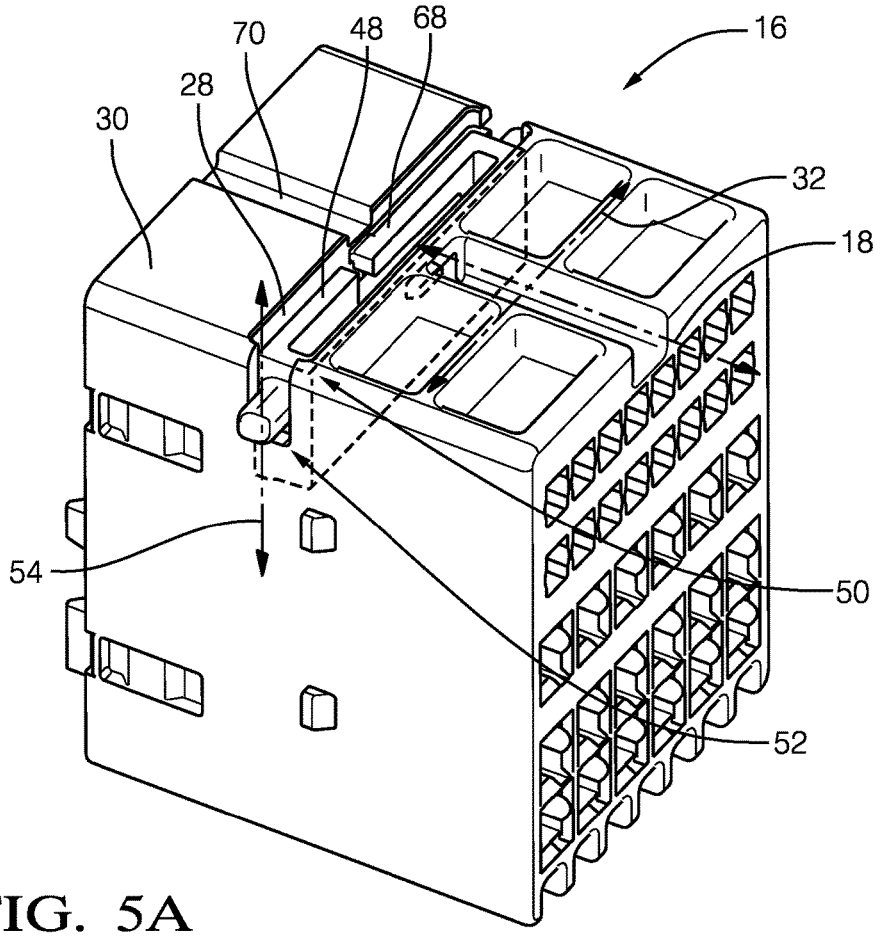
FIG. 5A is an illustration of the second-housing with a terminal-lock disposed within a slot of the second-housing in accordance with one embodiment.
Figure 5B:
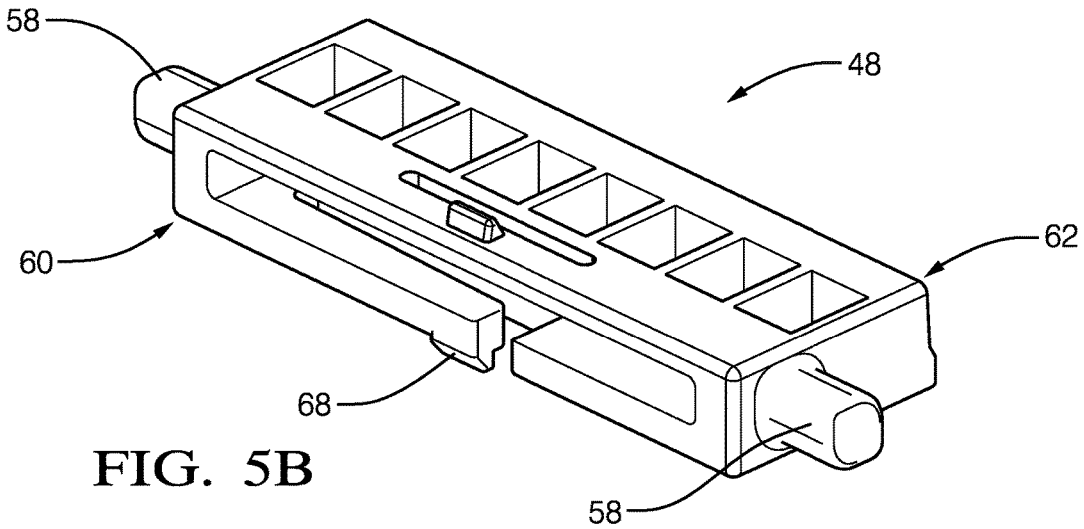
FIG. 5B is an illustration of the terminal-lock of FIG. 5A isolated from the second-housing in accordance with one embodiment.

FIG. 5A illustrates the second-housing 16 with the slideable-skirt 34 removed. The electrical connector 10 also includes a terminal-lock 48 (i.e. the vertical TPA device—see FIG. 5B) disposed within the slot 28 and moveable from a terminal insertion position 50 to a locking position 52. The terminal-lock 48 moves along a transverse-axis 54 which is orthogonal to the lateral-axis 32 and the longitudinal-mating-axis 18. The terminal insertion position 50 enables the assembler to insert the plurality of corresponding electrical terminals 20 into the second-housing 16 without interference from the terminal-lock 48.

Figure 6A:
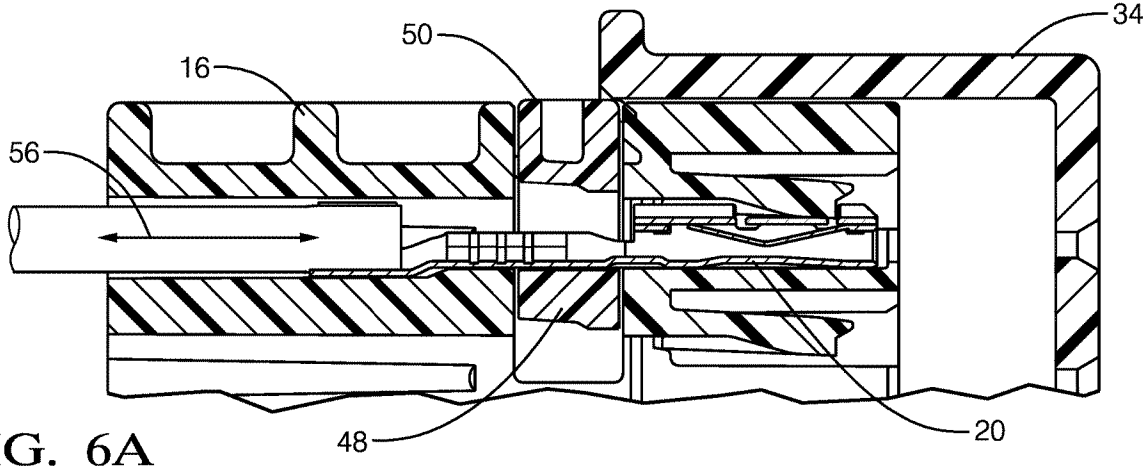
FIG. 6A is an illustration of the terminal-lock of FIG. 5B in a terminal insertion position in accordance with one embodiment.
Figure 6B:
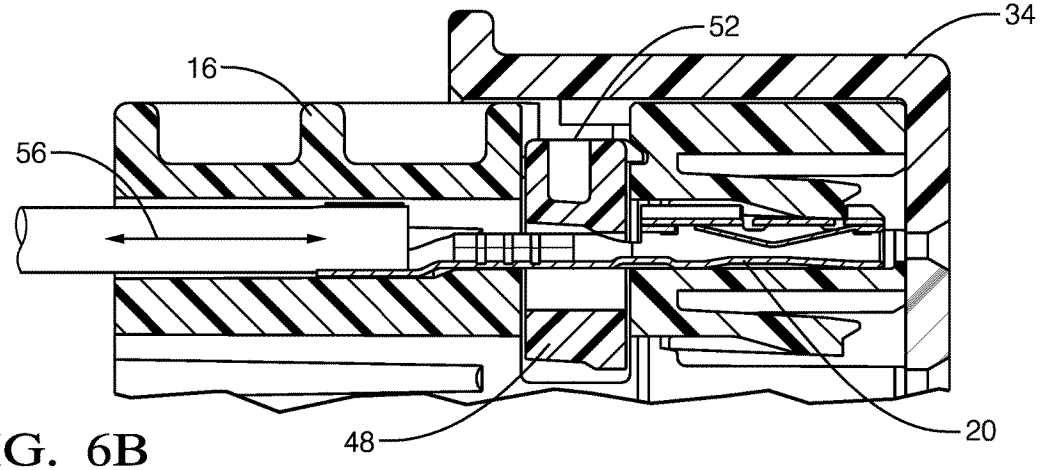
FIG. 6B is an illustration of the terminal-lock of FIG. 5B in a locking position in accordance with one embodiment.

FIGS. 6A-6B illustrate the terminal-lock 48 in the terminal insertion position 50 (FIG. 6A) and in the locking position 52 (FIG. 6B). The terminal-lock 48 is configured to inhibit a longitudinal-movement 56 of the plurality of corresponding electrical-terminals 20 by engaging retaining features on the bodies of the plurality of corresponding electrical-terminals 20.

Returning to FIG. 5B, the terminal-lock 48 includes cam-posts 58 extending from a first-end 60 and a second-end 62 of the terminal-lock 48 that are disposed within the cam-slots 40 of the slideable-skirt 34 (see FIGS. 4A-4B). The terminal-lock 48 moves from the terminal insertion position 50 to the locking position 52 as the slideable-skirt 34 is moved from the pre-stage position 36 to the seated-position 38 by the assembler as the cam-posts 58 travel in the cam-slots 40. The terminal-lock 48 may simultaneously engage the plurality of corresponding electrical-terminals 20 disposed within the first plurality of terminal-cavities 24 as the terminal-lock 48 moves from the terminal insertion position 50 to the locking position 52. That is, the terminal-lock 48 may engage the bodies of the plurality of the corresponding electrical-terminals 20 located in the top two rows of the second-housing 16.

Figure 7:
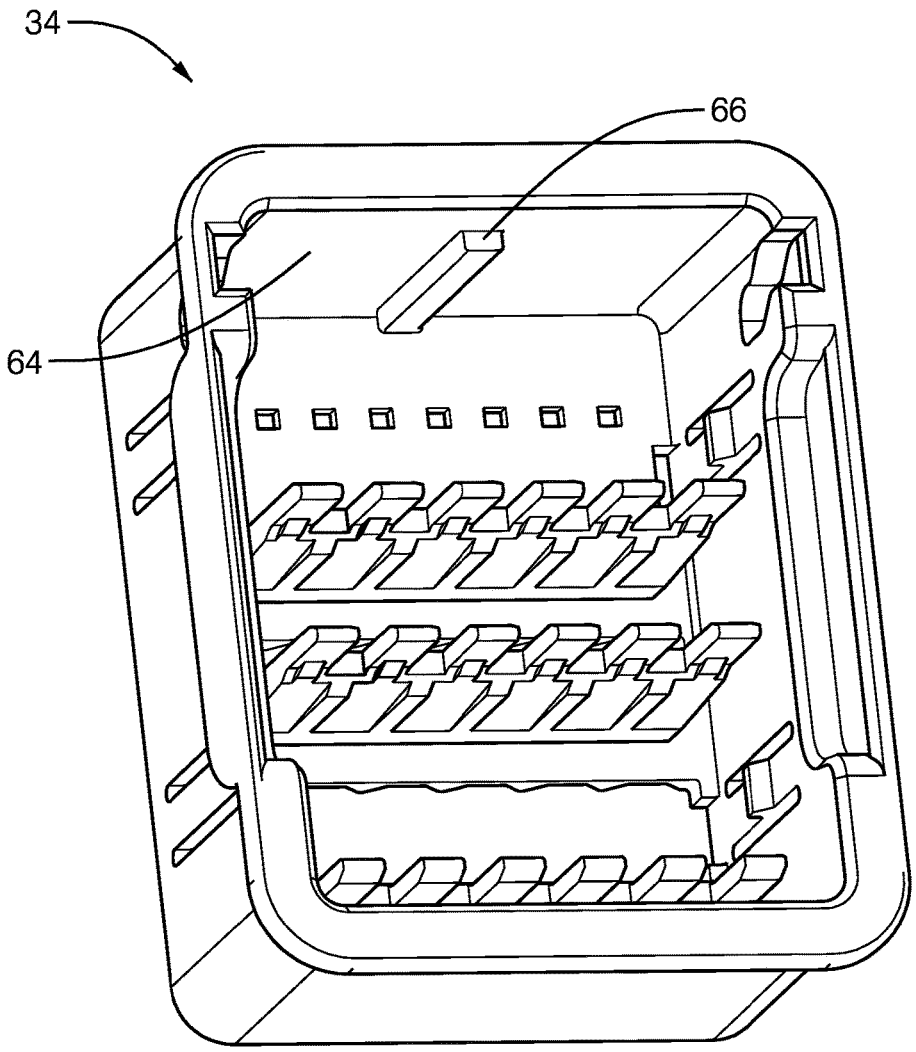
FIG. 7 is an illustration of an inner-surface of the slideable-skirt of FIG. 4B Fig. in accordance with one embodiment.

FIG. 7 illustrates an inner-surface 64 of the slideable-skirt 34. The slideable-skirt 34 may include an actuation-rib 66 projecting from the inner-surface 64 of the slideable-skirt 34, and the terminal-lock 48 may include a flexible-lock 68 (see FIGS. 5A-5B) that retains the terminal-lock 48 at the top-side 30 of the second-housing 16. The actuation-rib 66 may disengage the flexible-lock 68 and enable the terminal-lock 48 to move in the direction normal to the longitudinal-mating-axis 18 when the slideable-skirt 34 is moved from the pre-stage position 36 to the seated-position 38.

Returning to FIG. 5A, the second-housing 16 may further define a groove 70 in the top-side 30 of the second-housing 16 that extends to the slot 28 along the longitudinal-mating-axis 18. The actuation-rib 66 (see FIG. 7) and the flexible-lock 68 (see FIGS. 5A-5B) may both be disposed within the groove 70, having the benefit of reducing an overall size of the electrical connector 10.

Accordingly, an electrical connector 10 is provided. The electrical connector 10 is beneficial because the electrical connector 10 integrates two TPA devices that move along different orthogonal axes, e.g. axial and transverse, and accommodate the corresponding electrical-terminals 20 of varying dimensions, while not increasing the packaging size of the electrical connector 10. The electrical connector also provides the benefit of vertically moving the terminal-lock 48 along the transverse-axis 54 from the terminal insertion position 50 to the locking position 52 by axially moving the slideable-skirt 34 along the longitudinal-mating-axis 18.

While this invention has been described in terms of the preferred embodiments thereof, it is not intended to be so limited, but rather only to the extent set forth in the claims that follow. Moreover, the use of the terms first, second, etc. does not denote any order of importance, but rather the terms first, second, etc. are used to distinguish one element from another. Furthermore, the use of the terms a, an, etc. do not denote a limitation of quantity, but rather denote the presence of at least one of the referenced items. Additionally, directional terms such as upper, lower, etc. do not denote any particular orientation, but rather the terms upper, lower, etc. are used to distinguish one element from another and locational establish a relationship between the various elements.

We claim:

1. An electrical connector, comprising:

a first-housing that includes a plurality of electrical-terminals;

a second-housing configured to mate with the first-housing along a longitudinal-mating-axis, said second-housing includes a plurality of corresponding electrical-terminals configured to mate with the plurality of electrical-terminals of the first-housing, said second-housing defines a slot in a top-side of the second-housing extending along a lateral-axis orthogonal to the longitudinal-mating-axis;

a slideable-skirt mounted to the second-housing and moveable from a pre-stage position to a seated-position along the longitudinal-mating-axis, wherein the slideable-skirt overlays a portion of a perimeter of the second-housing and defines cam-slots on a first-side and a second-side of the slideable-skirt; and a terminal-lock disposed within the slot and moveable from a terminal insertion position to a locking position along a transverse-axis orthogonal to the lateral-axis and the longitudinal-mating-axis, said terminal-lock configured to inhibit a longitudinal-movement of the plurality of corresponding electrical-terminals, said terminal-lock includes cam-posts extending from a first-end and a second-end of the terminal-lock disposed within the cam-slots of the slideable-skirt, wherein the terminal-lock moves from the terminal insertion position to the locking position as the slideable-skirt is moved from the pre-stage position to the seated-position.

2. The electrical connector in accordance with claim 1, wherein the second-housing further defines a plurality of terminal-cavities, and wherein the terminal-lock simultaneously engages the plurality of corresponding electrical-terminals disposed within the plurality of terminal-cavities as the terminal-lock moves from the terminal insertion position to the locking position.

3. The electrical connector in accordance with claim 1, wherein the slideable-skirt includes an actuation-rib projecting from an inner-surface of the slideable-skirt, and the terminal-lock includes a flexible-lock that retains the terminal-lock at the top-side of the second-housing, wherein the actuation-rib disengages the flexible-lock and enables the terminal-lock to move in the direction normal to the longitudinal-mating-axis when the slideable-skirt is moved from the pre-stage position to the seated-position.

4. The electrical connector in accordance with claim 3, wherein the second-housing further defines a groove in the top-side of the second-housing that extends to the slot along the longitudinal-mating-axis, wherein the actuation-rib and the flexible-lock are both disposed within the groove.

* * * * *